US010099709B2

(12) United States Patent
Culbertson et al.

(10) Patent No.: US 10,099,709 B2
(45) Date of Patent: Oct. 16, 2018

(54) FOLDABLE RAILCAR HANDHOLD

(71) Applicants: James Culbertson, Euless, TX (US); James H. Jones, III, Arlington, TX (US); Stephen L. Uhrik, Rochardson, TX (US)

(72) Inventors: James Culbertson, Euless, TX (US); James H. Jones, III, Arlington, TX (US); Stephen L. Uhrik, Rochardson, TX (US)

(73) Assignee: BNSF Logistics, LLC, Springdale, AR (US)

( * ) Notice: Subject to any disclaimer, the term of this patent is extended or adjusted under 35 U.S.C. 154(b) by 57 days.

(21) Appl. No.: 15/239,934

(22) Filed: Aug. 18, 2016

(65) Prior Publication Data

US 2018/0050707 A1 Feb. 22, 2018

(51) Int. Cl.
*B61D 49/00* (2006.01)
*B61D 23/00* (2006.01)
*B61D 3/08* (2006.01)

(52) U.S. Cl.
CPC ..... *B61D 49/00* (2013.01); *B61D 3/08* (2013.01); *B61D 23/00* (2013.01)

(58) Field of Classification Search
CPC ... B25G 1/00; B61D 3/00; B61D 3/08; B61D 17/06; B61D 17/12; B61D 17/14; B61D 23/00; B61D 23/02; B61D 39/00; B61D 49/00
See application file for complete search history.

(56) References Cited

U.S. PATENT DOCUMENTS

| | | | | |
|---|---|---|---|---|
| 806,922 A | | 12/1905 | Saling et al. | |
| 1,093,020 A | | 4/1914 | Williams | |
| 1,118,404 A | | 11/1914 | Dunderdale | |
| 1,170,390 A | | 2/1916 | Armstrong et al. | |
| 1,179,665 A | * | 4/1916 | Shank | B61D 23/00 105/461 |
| 2,090,494 A | * | 8/1937 | Willoughby | B61D 3/08 105/384 |
| 2,164,586 A | * | 7/1939 | McBride | B61D 3/08 105/384 |
| 3,558,182 A | * | 1/1971 | Rosen | B62D 33/0207 105/382 |

(Continued)

OTHER PUBLICATIONS

International Search Report dated Aug. 4, 2017 in corresponding PCT patent application serial No. PCT/US2017/034957.

*Primary Examiner* — Jason C Smith
(74) *Attorney, Agent, or Firm* — Dan Brown Law Office; Daniel R. Brown

(57) ABSTRACT

A foldable handhold assembly for attachment to a railroad flatcar includes a handhold that has a pair of side rails connected with a horizontal grab bar. A pair of brackets, which each have a mounting surface conforming to the shape of the flatcar sill. The brackets each have a hinge that rotatably couples to the proximate end of one of the side rail, which enables the handhold to rotate about the hinges between a deployed position where the grab bar extends above the flatcar deck and a stowed position where the handhold extends below the flatcar deck. One of the brackets also has latch aligned to selectively retain the handhold at the deployed position.

19 Claims, 4 Drawing Sheets

(56) References Cited

U.S. PATENT DOCUMENTS

| | | | | | |
|---|---|---|---|---|---|
| 4,169,623 | A | * | 10/1979 | Smith | B60N 3/023 105/461 |
| 4,463,827 | A | * | 8/1984 | Sittner | B61D 37/00 182/194 |
| 4,757,768 | A | * | 7/1988 | Agelakopoulos | B61C 17/00 105/439 |
| 4,871,047 | A | * | 10/1989 | McLean | E06C 9/04 105/461 |
| 5,386,784 | A | * | 2/1995 | Meier | E06C 5/00 105/326 |
| 5,921,531 | A | * | 7/1999 | Early | B61D 7/00 105/437 |

* cited by examiner

Section A-A

FOLDABLE RAILCAR HANDHOLD

BACKGROUND OF THE INVENTION

Field of the Invention

The present invention relates to railcar handholds. More particularly, the present invention relates to foldable railcar handholds that provide additional load clearance when in a stowed position.

Description of the Related Art

All manner of railroad cars, rolling stock, and railcars employ hand grabs and ladders (collectively "handholds") to facilitate worker and passenger access to the vehicle. In fact, the American Association of Railroads ("AAR") has certain standards and requirements for handholds, which specify their location, dimensions, material, and strength requirements.

While handholds are necessary and convenient for access to railcars, their presence and location are not without some operational issues. They are generally located about the perimeter of the railcar, often times along the side sills and end sills of railcars, and generally extend upwardly to a height that facilitates a human climbing up to access a deck, floor, roof, access opening, or service platform of the railcar. The AAR also sets limits on clearance profiles for railroad passage, within which every railcar must pass, and this limits the dimensions of handholds, among other railcar protuberances. It is common for handholds to extend above railcar decks, floors, and platforms, which places them at a height even with railcar cargo locations. As cargo is loaded and off-loaded, it is not uncommon for handholds to interfere with movement of cargo on and off a railcar.

Particular on the case of railroad flatcars, which are utilized for carrying large and tall loads, the handholds often interfere with cargo loading and unloading, and may interfere with cargo in transit as well. Thus, it can be appreciated that there is a need in the art for an improved railcar handhold that addresses these cargo load and clearance issues.

SUMMARY OF THE INVENTION

The need in the art is addressed by the systems and methods of the present invention. The present disclosure teaches a foldable handhold assembly for attachment to a railcar. The assembly includes a handhold with a pair of side rails and a grab bar horizontally fixed between them. A pair of brackets, for attachment to the railcar, each have a hinge coupled to a distal end of one of the pair of side rails, which enables the handhold to rotate about the hinges between a deployed position, which upwardly orients the handhold, and a stowed position. In addition, at least one of brackets includes a first latch aligned to retain the handhold in the deployed position, and a second latch aligned to retain the pair of side rail in the stowed position.

In a specific embodiment of the foregoing assembly, the first latch includes a first bar that selectively engages a first slot in the first bracket, which latches the handhold at the deployed position. In addition, the second latch includes a second bar that selectively engages a second slot in the first bracket, which latches the handhold at the stowed position. In a refinement to this embodiment, the second brackets is identical to the first bracket.

In a specific embodiment of the foregoing assembly, the first bracket further includes a pair of side flanges opposingly disposed to define a vertical slot therebetween into which one of the pair of side rails passes to engage the hinge. In a refinement to this embodiment, the side rail is formed from round bar stock, and the distal end thereof is bent in a horizontal direction to provide a hinge spindle, and, one of the side flanges has a hole formed thereinto, which acts as a hinge barrel to engage the hinge spindle.

In another refinement to the foregoing embodiments, the pair of side flanges each has an upper bar slot formed therein that are aligned to receive a first movable bar, which selectively retains one of the side rails at the deployed position, and, the pair of side flanges each also has a lower bar slot formed therein that are aligned to receive a second movable bar, which selectively retains the side rails at the stowed position. In another refinement, the first movable bar and the second movable bar are rotatable retained by pins through the side flanges, and, the first movable bar and the second movable bar are retained in latched position under force of gravity. In another refinement, the first movable bar and the second movable bar each include a bar operator extension that extends outward of the pair of side rails to facilitate movement of the first movable bar and the second movable bar.

In a specific embodiment of the foregoing assembly, the handhold dimensions and the stowed position are selected to maintain the handhold within railroad railway clearance requirements while in the stowed position. In another specific embodiment, the mounting surface is shaped to conform to a mounting location on the railcar, and the mounting surface includes at least a first mounting hole, which is affixed to the railcar using a through-hole fastener.

The present disclosure teaches a foldable handhold assembly for attachment to a railroad flatcar that has a sill and a deck. The assembly includes a handhold that has a pair of side rails connected with a horizontal grab bar. The assembly also includes a pair of brackets, which each have a mounting surface conforming to the shape of the flatcar sill for attachment thereto. The brackets each have a hinge that rotatably couple to the proximate end of one of the side rail, which enables the handhold to rotate about the hinges between a deployed position where the grab bar extends above the flatcar deck and a stowed position where the handhold extends below the flatcar deck. One of the brackets also has latch aligned to selectively retain the handhold at the deployed position.

In a specific embodiment of the foregoing assembly, one of the brackets further includes a second latch aligned to selectively retain the handhold at the stowed position, and, the first latch includes a first bar that selectively engages a first slot in the bracket to latch the handhold at the deployed position. In a refinement to this embodiment, the second latch includes a second bar that selectively engages a second slot in the bracket to latch the handhold at the stowed position. In a further refinement, the assembly includes a second bracket that is identical to the first bracket.

In a specific embodiment of the foregoing assembly, one of the brackets further includes a pair of side flanges opposingly disposed to define a vertical slot between them into which one of the side rails passes to engage the hinge. In a refinement to this embodiment, the side rails are formed from round bar stock, and the distal end is bent in a horizontal direction to provide a hinge spindle, and, one of the side flanges has a hole formed thereinto, which acts as a hinge barrel to engage the hinge spindle.

In another refinement to the foregoing assembly, the pair of side flanges each has an upper bar slot formed therein that are aligned to receive a first movable bar, which selectively retains one of the pair of side rails at the deployed position, and, the pair of side flanges each has a lower bar slot formed therein that are aligned to receive a second movable bar, which selectively retains the one of the pair of side rails at the stowed position. In a refinement to this embodiment, the first movable bar and the second movable bar are rotatable retained by pins through one of the side flanges, and, the first movable bar and the second movable bar are retained in latched position under force of gravity. In yet another refinement, the first movable bar and the second movable bar each include a bar operator extension that extends outward of the pair of side rails to facilitate movement of the first movable bar and the second movable bar.

In a specific embodiment of the foregoing assembly, the handhold dimensions and the stowed position are selected to maintain the handhold within railroad railway clearance requirements while in the stowed position. In another specific embodiment, the mounting surface is shaped to conform to a mounting location on the railcar, and includes at least a first mounting hole, which is affixed to the railcar using a through-hole fastener.

DESCRIPTION OF THE INVENTION

Figure 1:
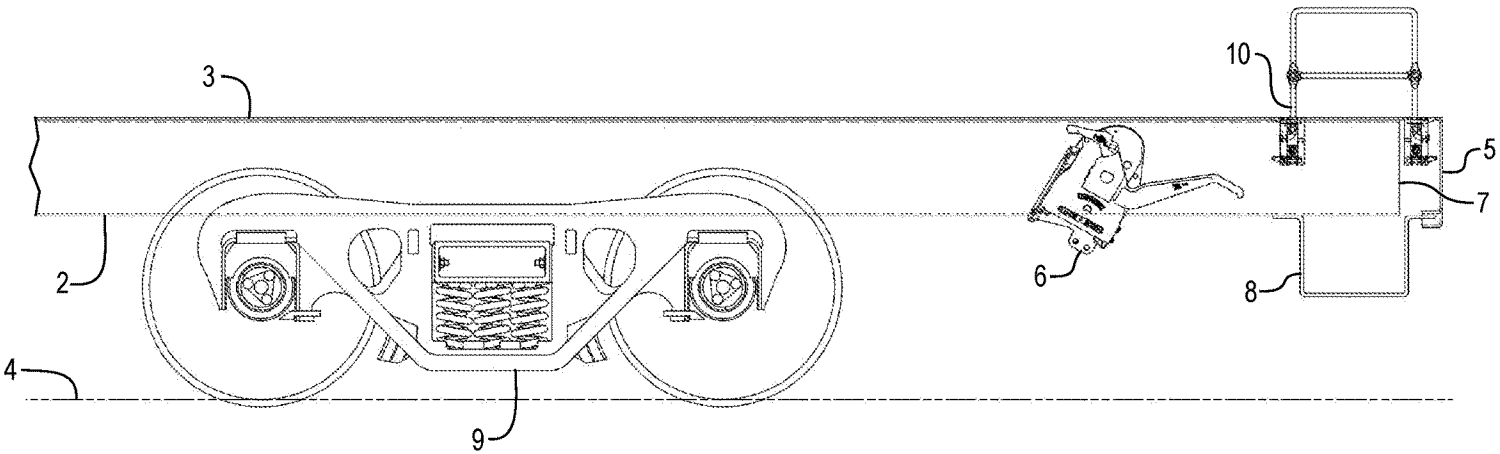
FIG. 1 is a side view drawing of a flatcar with a foldable handhold assembly according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The teachings herein address the challenges associated with transporting large objects by railcar, such as wind turbine blades transported on rail flatcars. Such large objects are hoisted onto the deck of a flatcar, where every inch of clearance is critical. However, the teachings herein are suitable for use with all manner of railcars and cargo where clearance, and the presence of handhold and other fixtures, may interfere with the loading, transport, and unloading of cargo. The AAR design criteria of handhold often times place these object at interfering locations with respect to cargo. It is common for rail loading specifications to require that the handholds be removed from the railcar for transit of large objects, such as wind turbine blades, and then be reattached after the load has been transported and off-loaded. This approach bears considerable costs, and results in wear and tear on the railcars. The materials and strength requirements for handholds, according to the AAR, are substantial. These generally require the use of steel elements and connections that are durable and long lasting.

The present invention advances the art by providing foldable handholds that are strong, safe, and durable. In one embodiment, a pair of brackets are affixed to a side sill of a railcar, and the brackets engage a handhold that employs a pair of side rails and one or more horizontal grab bars. In a deployed position, the handhold is oriented vertically, so as to facilitate human access for climbing up and onto a railcar horizontal surface, such as the deck of a flatcar. The handhold side rails are rotatably coupled to the brackets with hinges, which facilitates rotation of the bracket so a stowed position where the handhold is at or below the railcar deck or other selected surface. This provides a clear deck surface for loading, transporting and unloading cargo. Latches are provided to retain the handhold at either of the deployed or stowed positions. In the stowed position, care is taken to ensure that the handhold is retained at a position that will clear the AAR railway clearance profile requirements. For safety, strength, reliability, and durability, latches are provided in pairs, one for each side rail, so that failure of a single latch will not result in failure of the assembly. Latches are employed that are easily manipulated by hand, and will remain functional even after extended exposure to the elements. Latches are also provided to retain the handhold in the stowed position.

Reference is direct to FIG. 1, which is a side view drawing of a flatcar 2 with a foldable handhold assembly 10 according to an illustrative embodiment of the present invention. This view is provided to orient the reader as to the operating environment of this embodiment. The railcar is a flatcar 2 with a horizontal deck 3 onto which cargo (not shown) is loaded. Wheel truck assembly 9 ride on rails, depicted by phantom line 4. The flatcar 2 includes side sill 7 and end sill 5, as are know to those skilled in the art. A hand brake 6 is also illustrated. In this embodiment, a handhold assembly 10 is fixed to the side sill 7, and functions cooperatively with a sill step 8, as are known in the art. The sill step 8 does not require a folding bracket because is it already below the flatcar deck 3 and does not interfere with cargo operations or railway clearance profile dimensions.

Figure 2:
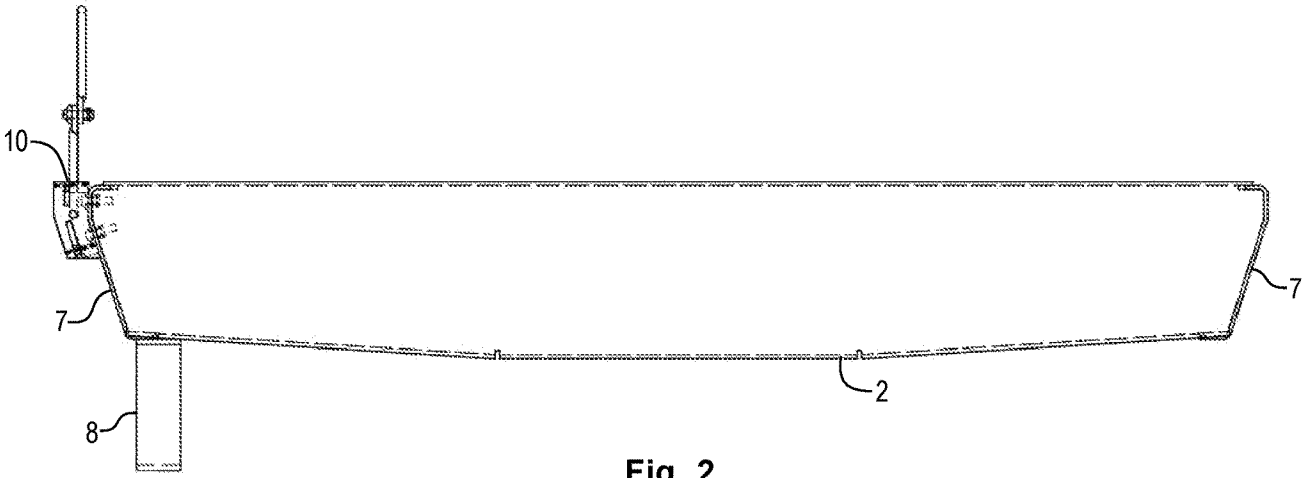
FIG. 2 is an end view drawing of a flatcar with a foldable handhold assembly according to an illustrative embodiment of the present invention.

Reference is direct to FIG. 2, which is an end view drawing of a flatcar 2 with a foldable handhold assembly 10 according to an illustrative embodiment of the present invention. FIG. 2 corresponds with FIG. 1. In FIG. 2, the side sills 7 can be more clearly seen, as well as the attachment location of the foldable handhold assembly 10 and its orientation with respect to the existing sill step 8. Note that the side sill 7 is a formed plate with a vertical and tapered portion.

Figure 4:
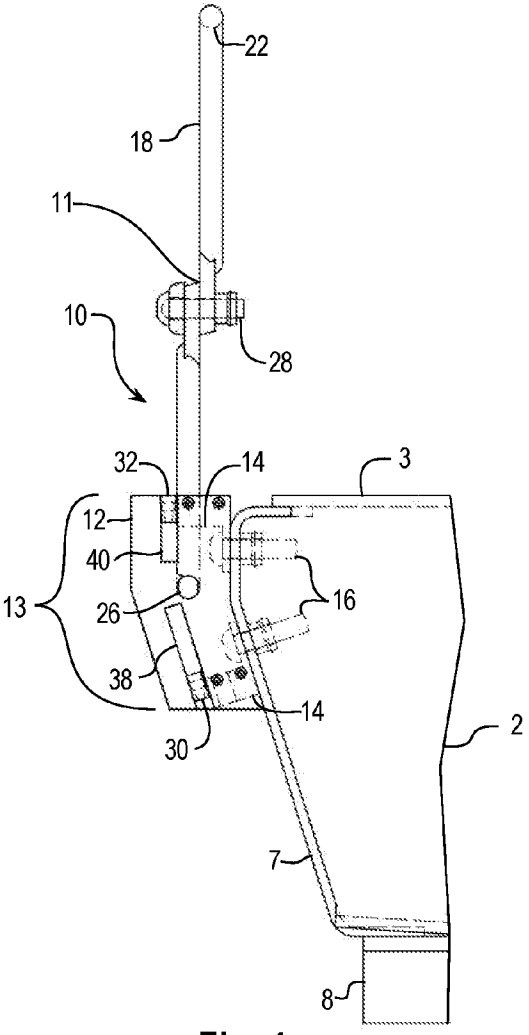
FIG. 4 is an end view drawing of a foldable handhold assembly according to an illustrative embodiment of the present invention.
Figure 3:
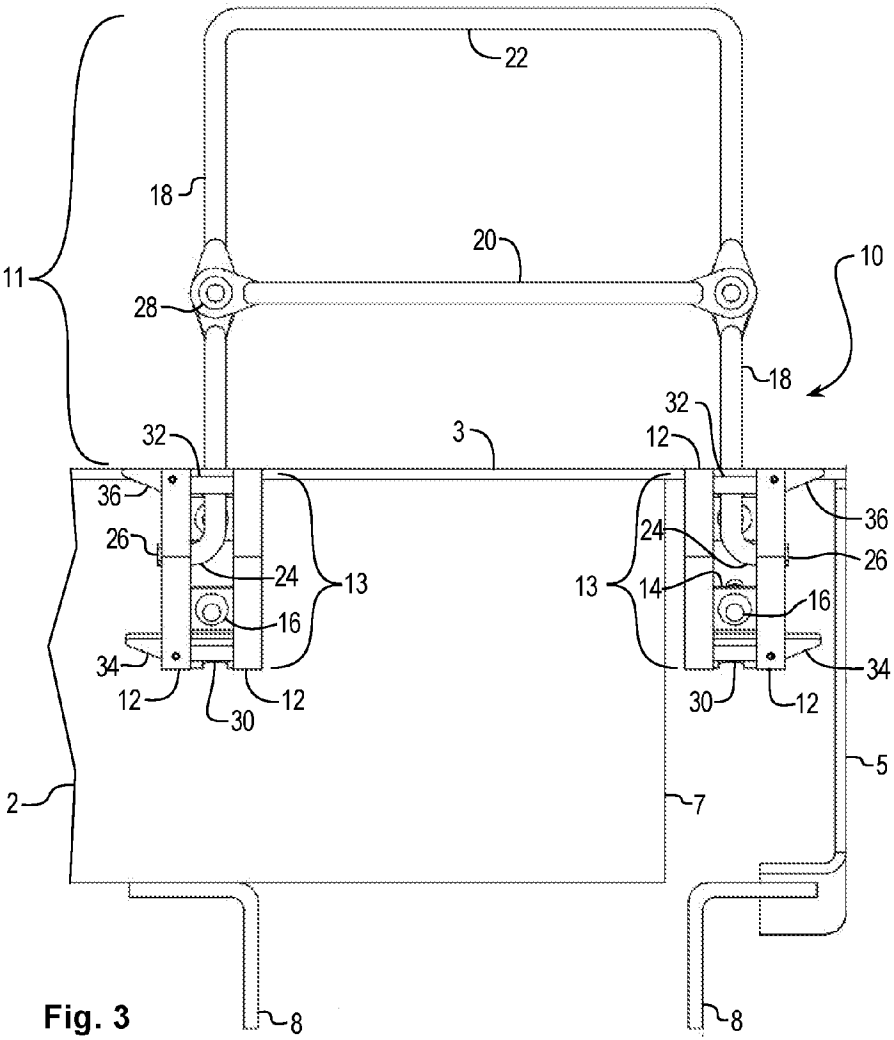
FIG. 3 is a side view drawing of a foldable handhold assembly according to an illustrative embodiment of the present invention.

Reference is direct to FIG. 3 and FIG. 4, which are a side view drawing and an end view drawing, respectively, of a foldable handhold assembly 10 according to an illustrative embodiment of the present invention. These views provide further details of the foldable handhold assembly 10 structure and attachment to the flatcar 2. In these views, the flatcar 2 is illustrated, in part, including the deck 3, the side sill 7, the end sill 5, and the sill step 8, as discussed herein before. The foldable handhold assembly 10 is comprised of the handhold 11 and a pair of brackets 13. The handhold 11 is comprised of a pair of side rails 18 and two grab bars 20, 22. The number of grab bars can range in from one to many. The lower ends of the pair of side rails 18 are bent outwardly to form a spindle 24 portion of a hinge. The spindle portions 24 rotatably engage a hinge barrel 26, which is a hole formed into one of a pair of side flanges 12, which constitute a portion of a pair of brackets 13. Note that each bracket 13 is comprised of a pair of side rails 12, and mounting members 14, which have a mounting surface that engages the side sill 7 of the railcar 2. The mounting members 14 mounting surface is aligned with the surface of the side sill 7, so as to present a conformal mounting arrangement.

The handhold 11 in FIGS. 3 and 4 is retained in the deployed position (as illustrated) using a pair of upper bar latches 32, one in each of the pair of brackets 13. The upper bar latches 32 are positioned within upper bar slots 40 formed in the side flanges 12 of the brackets 13 so as to retain the pair of side rails 18 in the deployed position, as illustrated. In addition, there is a pair of lower bar latches 30 that engage lower bar slots 38, which serve to retain the handhold 11 in the stowed position (not illustrated in these views). The bar latches also comprise a bar operator, item 36 for the upper bar latch 32 and item 34 for the lower bar latches 30, which provide convenient access for operation of the latches. The mounting member 14 comprises holes and through-hole fasteners 16, which fix the brackets 13 to the flatcar side sill 7 in a conformal and cooperative manner. In the illustrative embodiment, bolts or rivets are employed for fastening.

Figure 5:
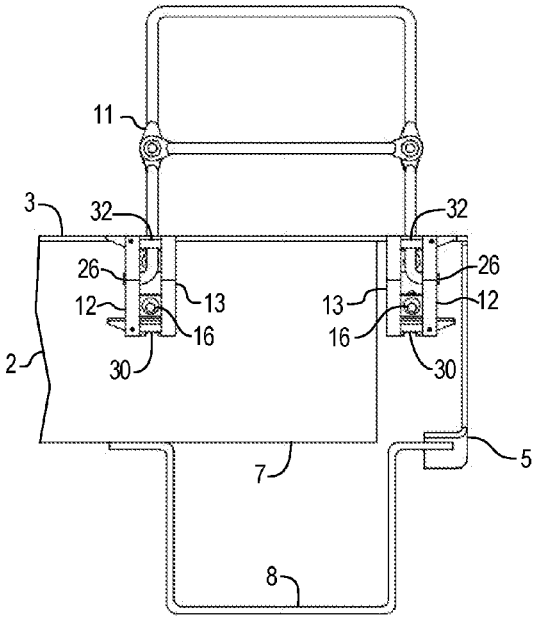
FIG. 5 is a side view drawing of a foldable handhold assembly in the deployed position according to an illustrative embodiment of the present invention.
Figure 6:
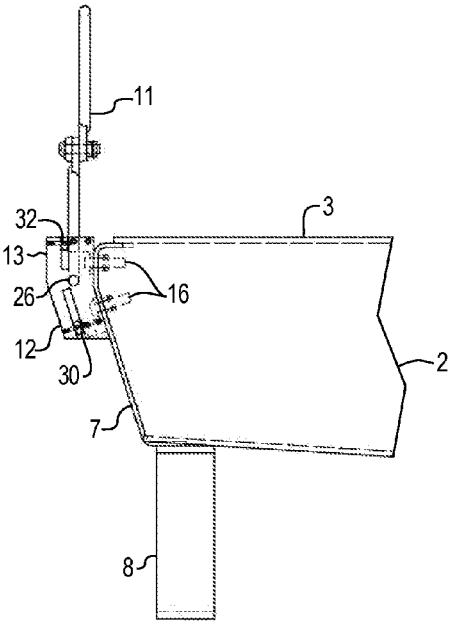
FIG. 6 is an end view drawing of a foldable handhold assembly in the deployed position according to an illustrative embodiment of the present invention.

Reference is direct to FIG. 5 and FIG. 6, which are a side view drawing and an end view drawing, respectively, of a foldable handhold assembly in the deployed position according to an illustrative embodiment of the present invention. FIGS. 5 and 6 correspond to FIGS. 3 and 4. In FIGS. 5 and 6, the flatcar 2, flatcar deck 3, side sill 7, end sill 5, and sill step 8 are again illustrated. Note that the brackets 13 are bolted 16 to the flatcar side sill 7 with a conformal arrangement. The handhold 11 is in the deployed position, as illustrated. The upper bar latch 32 on each of the brackets 13 retain the handhold 11 in the deployed position by preventing rotation about the hinge barrel 26 in the side flanges 12. The lower bar latches 30 are not utilized in the deployed position.

Figure 7:
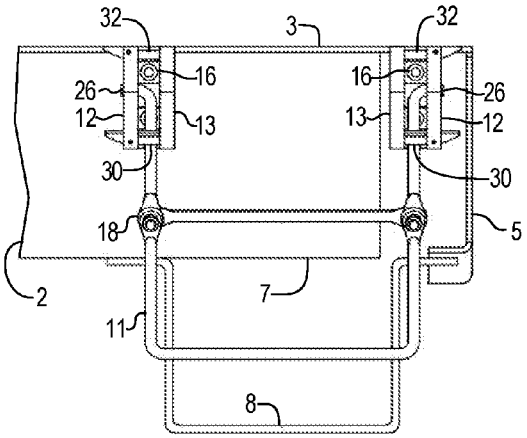
FIG. 7 is a side view drawing of a foldable handhold assembly in the stowed position according to an illustrative embodiment of the present invention.
Figure 8:
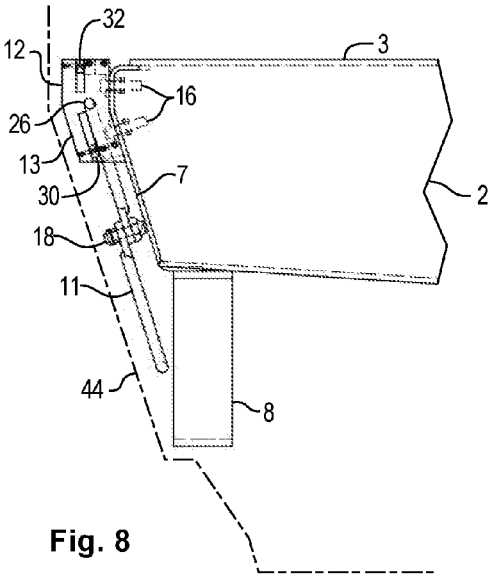
FIG. 8 is an end view drawing of a foldable handhold assembly in the stowed position according to an illustrative embodiment of the present invention.

Reference is direct to FIG. 7 and FIG. 8, which are a side view drawing and an end view drawing, respectively, of a foldable handhold assembly in the stowed position according to an illustrative embodiment of the present invention. FIGS. 7 and 8 correspond with FIGS. 5 and 6. In FIGS. 7 and 8, the handhold 11 has been rotated about the hinge barrel 26 in the side flanges 12 of the brackets 13 to the stowed position, as illustrated. This action is enabled by operating the upper bar latches 32 to release the handhold 11 from the deployed position, and then operating the lower bar latches 30 to secure the handhold 11 in the stowed position, as illustrated. The lower bar latches 30 retain the handhold 18 against rotation, thereby keeping the handhold within the constraints of the AAR railroad clearance limitation, depicted by phantom line 44. Were the lower bar latches 30 not utilized, the handhold 11 would hang straight down under the force of gravity, and interfere with the clearance profile 44.

Figure 9:
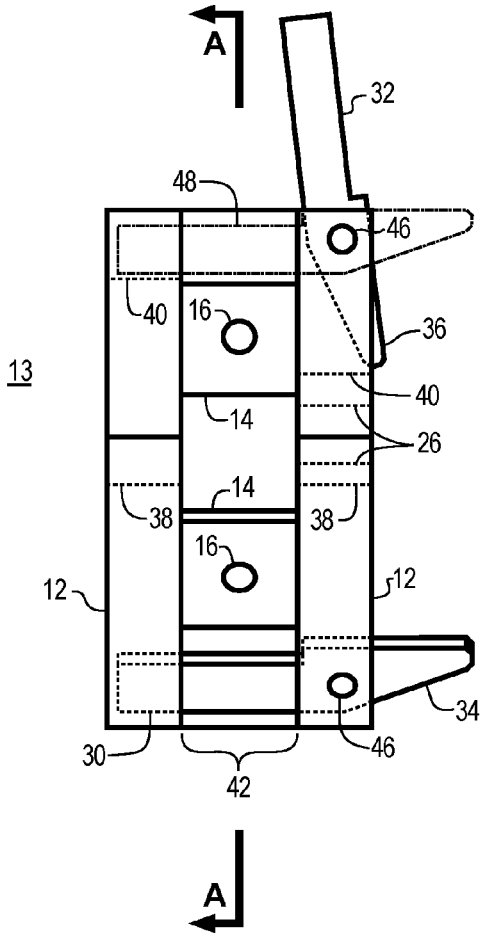
FIG. 9 is a side view drawing of a handhold bracket according to an illustrative embodiment of the present invention.
Figure 10:
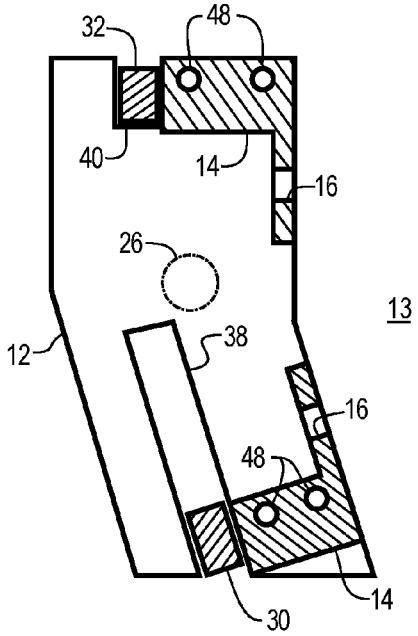
FIG. 10 is a side section view drawing of a handhold bracket according to an illustrative embodiment of the present invention.

Reference is direct to FIG. 9 and FIG. 10, which are a side view drawing and a side section view drawing taken along line A-A, respectively, of a foldable handhold assembly bracket 13 according to an illustrative embodiment of the present invention. These figures provide further details on the construction of the brackets 13. Note that the side flanges 12 are connected by the mounting members 14 using threaded fasteners (not shown) engaging holes 48 in the side flanges 12 and mounting members 14. The mounting members have holes 16 for through-hole fasteners (not shown) for connection to the host railcar. In the illustrative embodiment, the mounting members 14 are angle brackets formed from steel. Those skilled in the art will recognize that other mounting member configurations could also be employed. The side flanges 12 are formed with an interior angular cut that matches the angle of the railcar side sill (not shown), and the mounting members are also positioned to conform to this angle. The mounting members 14 width defines a vertical slot 42 between the side flanges 12, and this is the space within which the side rails (not shown) pass as they are rotated.

The side flanges 12 in FIGS. 9 and 10 also comprise upper bar slots 40 and lower bar slots 38, which retain and align the upper bar 32 and the lower bar 30. The bars 30, 32 and bar slots 38, 40 function cooperatively to enable the bar latches of the illustrative embodiment. Each of the bars 30, 32 have a bar operator 34, 36, respectively, which extend outward of the side flanges 12 to enable operator access. The bars are pinned 46 to the side flanges 12 to facilitate a hinge about which the bars 30, 32 rotate to clear the vertical slot 42 for rotation of the side rails (not shown). The upper bar 32 is illustrated in the raised position, which provides clearance for rotation of the side rails (not shown), and the upper bar is also illustrated by phantom line 48 in the closed position. Similar operation is employed for the lower bar 30. Note that the bar slots 38, 40 width and length are selected to enable sufficient clearance for rotation and movement of the various components, even in the presence of rust and corrosion. Also note the location of the hinge barrel hole 26, which is shown in phantom line in FIG. 10 since the section view places the physical hole above the drawing plane of FIG. 10.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A foldable handhold assembly for attachment to a railcar, comprising:

a handhold having a pair of side rails with a grab bar horizontally fixed therebetween;

a pair of brackets configured for fixed attachment to the railcar, each having a hinge coupled to a distal end of one of said pair of side rails, to thereby enable said handhold to rotate about said hinges between a deployed position, which upwardly orients said handhold, and a stowed position, and wherein at least a first one of said pair of brackets comprises a first latch aligned to retain said handhold in said deployed position, and a second latch aligned to retain said pair of side rails in said stowed position.

2. The foldable handhold assembly of claim 1, and wherein:

said first latch comprises a first bar that selectively engages a first slot in said at least a first one of said pair of brackets, to thereby latch said handhold at said deployed position, and wherein said second latch comprises a second bar that selectively engages a second slot in said at least a first one of said pair of brackets, to thereby latch said handhold at said stowed position.

3. The foldable handhold assembly of claim 2, and wherein:

a second one of said pair of brackets is identical to said first one of said pair of brackets.

4. The foldable handhold assembly of claim 1, and wherein:

a first one of said pair of brackets further comprises a pair of side flanges opposingly disposed to define a vertical slot therebetween into which a first one of said pair of side rails passes to engage said hinge.

5. The foldable handhold assembly of claim 4, and wherein:

said one of said pair of side rails is formed from round bar stock, and wherein said distal end thereof is bent in a horizontal direction to provide a hinge spindle, and wherein one of said pair of side flanges has a hole formed thereinto, which acts as a hinge barrel to engage said hinge spindle.

6. The foldable handhold assembly of claim 4, and wherein:

said pair of side flanges each has an upper bar slot formed therein that are aligned to receive a first movable bar, which selectively retains one of said pair of side rails at said deployed position, and said pair of side flanges each has a lower bar slot formed therein that are aligned to receive a second movable bar, which selectively retains said one of said pair of side rails at said stowed position.

7. The foldable handhold assembly of claim 6, and wherein:

said first movable bar and said second movable bar are rotatable retained by pins through one of said pair of side flanges, and wherein said first movable bar and said second movable bar are retained in latched position under force of gravity.

8. The foldable handhold assembly of claim 7, and wherein:

said first movable bar and said second movable bar each comprise a bar operator extension that extends outward of said pair of side rails to thereby facilitate movement of said first movable bar and said second movable bar.

9. The foldable handhold assembly of claim 1, and wherein:

said handhold dimensions and said stowed position are selected to maintain said handhold within railroad railway clearance requirements while in said stowed position.

10. The foldable handhold assembly of claim 1, and wherein:

said mounting surface is shaped to conform to a mounting location on the railcar, and said mounting surface includes at least a first mounting hole, which is affixed to the railcar using a through-hole fastener.

11. A foldable handhold assembly for attachment to a railroad flatcar having a sill and a deck, comprising:

a handhold having a pair of side rails with a grab bar horizontally fixed therebetween;

a pair of brackets, each having a mounting surface conforming to the shape of the flatcar sill for attachment thereto, and each having a hinge rotatably coupled to a proximate end of one of said pair of side rails, to thereby enable said handhold to rotate about said hinges between a deployed position wherein said grab bar extends above the flatcar deck and a stowed position wherein said handhold extends below the flatcar deck, and wherein at least a first one of said pair of bracket comprises a first latch aligned to selectively retain said handhold at said stowed position, and wherein, said at least a first one of said pair of brackets further comprises a second latch aligned to selectively retain said handhold at said deployed position, and wherein said first latch comprises a first bar that selectively engages a first slot in said at least a first one of said pair of brackets, to thereby latch said handhold at said position.

12. The foldable handhold assembly of claim 11, and wherein:

said second latch comprises a second bar that selectively engages a second slot in said at least a first one of said pair of brackets, to thereby latch said handhold at said deployed position, and wherein a second one of said pair of brackets is identical to said first one of said pair of brackets.

13. The foldable handhold assembly of claim 11, and wherein:

a first one of said pair of brackets further comprises a pair of side flanges opposingly disposed to define a vertical slot therebetween into which a first one of said pair of side rails passes to engage said hinge.

14. The foldable handhold assembly of claim 13, and wherein:

said one of said pair of side rails is formed from round bar stock, and wherein said distal end thereof is bent in a horizontal direction to provide a hinge spindle, and wherein one of said pair of side flanges has a hole formed thereinto, which acts as a hinge barrel to engage said hinge spindle.

15. The foldable handhold assembly of claim 13, and wherein:

said pair of side flanges each has an upper bar slot formed therein that are aligned to receive a first movable bar, which selectively retains one of said pair of side rails at said stowed position, and said pair of side flanges each has a lower bar slot formed therein that are aligned to receive a second movable bar, which selectively retains said one of said pair of side rails at said deployed position.

16. The foldable handhold assembly of claim 15, and wherein:

said first movable bar and said second movable bar are rotatable retained by pins through one of said pair of side flanges, and wherein said first movable bar and said second movable bar are retained in latched position under force of gravity.

17. The foldable handhold assembly of claim 16, and wherein:

said first movable bar and said second movable bar each comprise a bar operator extension that extends outward of said pair of side rails to thereby facilitate movement of said first movable bar and said second movable bar.

18. The foldable handhold assembly of claim 11, and wherein:

said handhold dimensions and said stowed position are selected to maintain said handhold within railroad railway clearance requirements while in said stowed position.

19. The foldable handhold assembly of claim 11, and wherein:

said mounting surface is shaped to conform to a mounting location on the railcar, and said mounting surface includes at least a first mounting hole, which is affixed to the railcar using a through-hole fastener.

* * * * *